US005169011A

United States Patent [19]

Ebeling et al.

[11] Patent Number: 5,169,011

[45] Date of Patent: Dec. 8, 1992

[54] CARGO UNIT

[75] Inventors: Jaakko Ebeling, Kauniainen; Jarmo Pesonen, Espoo, both of Finland

[73] Assignee: Jaakko Poyry Oy, Helsinki, Finland

[21] Appl. No.: 536,594

[22] PCT Filed: Jan. 5, 1989

[86] PCT No.: PCT/FI89/00003

§ 371 Date: Aug. 23, 1990

§ 102(e) Date: Aug. 23, 1990

[87] PCT Pub. No.: WO89/06211

PCT Pub. Date: Jul. 13, 1989

[30] Foreign Application Priority Data

Jan. 6, 1988 [FI] Finland ..... 880043

[51] Int. Cl.[5] ..... A47F 5/00

[52] U.S. Cl. ..... 211/195; 108/53.1; 211/194

[58] Field of Search ..... 211/195, 187, 194; 108/51.1, 53.1, 56.1

[56] References Cited

U.S. PATENT DOCUMENTS

| | | | |
|---|---|---|---|
| 2,699,911 | 1/1955 | Chase et al. | 211/194 X |
| 2,956,763 | 10/1960 | D'Avca | 211/195 X |
| 3,565,018 | 2/1971 | Jay | 108/53.1 |
| 3,628,805 | 12/1971 | Archer | 108/53.1 X |
| 3,665,869 | 5/1972 | Howe | 108/53.1 |
| 4,353,520 | 10/1982 | Jansson | 108/56.1 X |
| 4,638,744 | 1/1987 | Clive-Smith | 108/53.1 X |

FOREIGN PATENT DOCUMENTS

| | | |
|---|---|---|
| 0049443 | 4/1982 | European Pat. Off. . |
| 59067 | 2/1981 | Finland . |
| 71908 | 11/1986 | Finland . |
| 2447325 | 8/1980 | France . |

*Primary Examiner*—Robert W. Gibson, Jr.
*Attorney, Agent, or Firm*—Pennie & Edmonds

[57] ABSTRACT

The invention relates to a cargo unit having a rectangular bottom flat (2) provided with ends (3), the upper corners of the ends and respectively the lower surface of the flat having gripping and guide members (8, 8') for the stacking of the cargo units one on top of another and for the automatic transfer of the cargo unit. The cargo unit has several intermediate flats (1) having a length approximately the same as the mutual distance of the ends (3) and a width at maximum that of the flat (2), and fastening members (5) for fastening the intermediate flats (1) at desired heights one above another, and possibly adjacently, to bear on the ends (3).

18 Claims, 6 Drawing Sheets

CARGO UNIT

Figure 1:
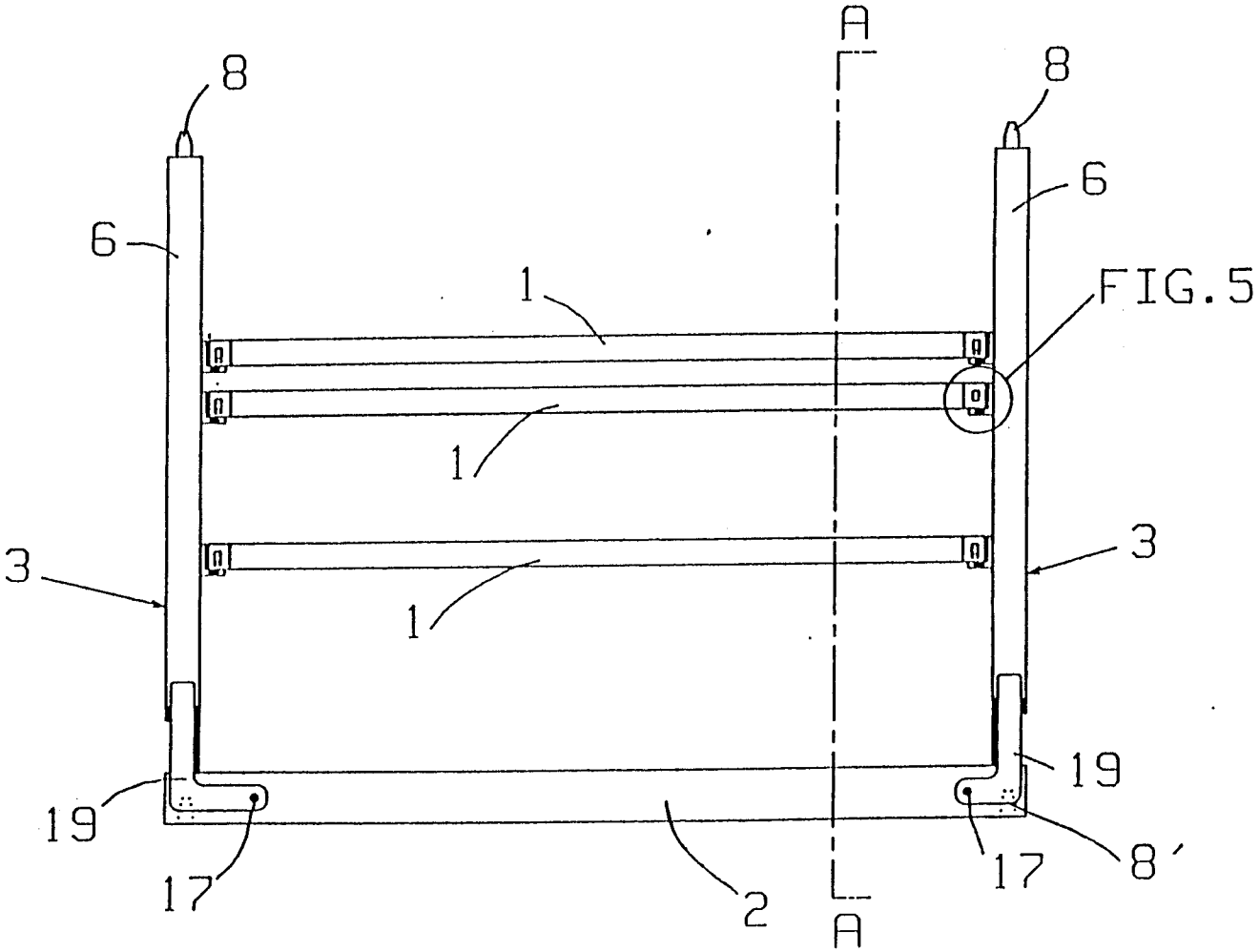

The present invention relates to a cargo unit intended for use in freight vessels, the unit having a rectangular flat fitted with ends, the ends having at their upper edges, preferably at least at their upper corners, and respectively on the lower surface of the flat, gripping and guide members for stacking two or more cargo units one on top of the other and for the automatic transfer of each cargo unit.

From Finnish Patent 71908 there is known a cargo unit of the above-mentioned type, which has, at each corner of a rectangular flat, upward- and downward-oriented gripping and guide members by means of which the ends, provided at their upper and lower corners with corresponding gripping and guide members, can be coupled to the flat, the loading attachments of the overhead crane of the freight vessel and the gripping devices of the cargo-unit trailer being provided with corresponding gripping and guide members for the automatic hoisting and releasing of the cargo unit. Such a cargo unit is usually dimensioned to accommodate four 20 -feet standard containers in pairs, adjacently and one on top of another.

A cargo unit of the above-mentioned type can efficiently be loaded full in a harbor, for example with newsprint or cellulose bales, whereby a full-loaded cargo unit is obtained. When the cargo space on a ship is filled with such units, the cargo space available on the ship can be exploited almost to the full in vessels referred to in Finnish Patent 71908, and thus maximally low marine transport costs are achieved.

If the character of the goods to be transported is such that, owing to their high sensitivity to damage or the irregular shape of the goods or the packages, the goods cannot be loaded one on top of another, a situation is arrived at in which all known loading systems lead to incomplete filling of the cargo space or to excessive risks of damage. A typical export transport chain may include as many as 13 separate handlings of an individual package between the manufacturer and the end user of the product. This circumstance has led to an increase in cases of damage, as the degree of refining of products has risen and especially as the packaging and shapes of products have become more and more irregular in dimensions (sheet paper on pallets, small rolls of paper, and other refined paper qualities).

Success in the export efforts of the export industry also in times of depression is greatly dependent on the condition in which the customer will receive the products. The seller who can guarantee that all products will arrive at the destination undamaged and economically will certainly be in a better position than a seller whose products, and usually the most expensive products, are likely to be damaged during transport.

The cargo unit according to Finnish patent 71908 mentioned above has the disadvantage that often goods having a smaller height than the height of the ends of the cargo unit are loaded on the cargo unit, in which case empty space is left in the upper part of the cargo unit, and this space cannot be filled up if the goods transported on the cargo unit are sensitive and prone to damage and cannot endure being loaded one item on top of another. Thus the degree of filling of such cargo units is usually low.

The object of the present invention is to eliminate the above-mentioned disadvantages and to provide a cargo unit of the type referred to in the preamble, the degree of filling of the cargo unit being higher than previously even in the transport of goods which are sensitive to damage and expensive, as well as of varying size and shape, and flats loaded at the factory being capable of being transferred in the cargo unit, by road or rail, to harbor terminals and, via marine transport, again onto a truck or a train in the country of destination, without the product loaded on the flat or the transport packaging of the product having to be touched before arrival at the final warehouse of the customer. The flats can in this case be handled as whole units with their cargo in harbor terminals, and the flats are always loaded on board a ship as part of the cargo unit.

According to the present invention this task has been solved by using as the flats mentioned above flats having a length which is approximately the same as the distance of the pivotable ends of the cargo unit from one another and a width which is at maximum the same as that of the flat of the cargo unit, and by attaching several such flats to bear on the ends of the cargo unit at the desired height as intermediate flats one above another or possibly adjacently, the distances of the intermediate flats from each other and from the bottom flat of the cargo unit being adjustable in the vertical direction according to the height of the goods to be transported so that the degree of filling can be maximized without the weight of the goods at the top bearing on the good below. A maximal degree of filling can be achieved when goods of approximately equal height are placed on the same intermediate flat.

From publication EP-A1 0 049 443 there is in fact known a collapsible flat equipped with shelves, in which the shelves can be attached at predetermined heights. This solution is in itself known, for example, from bookshelves.

However, there has been a need for a cargo unit according to the present invention for a long time, about 30 years, i.e. since the adoption of Ro-Ro vessels. Still, no one has come to think that the above problems could be solved simply in accordance with the present invention. One reason for this may have been the great size and weight of the cargo units, over 100 t. Owing to this immense size difference, an expert in the art has obviously not been able to apply the idea of intermediate shelves known from bookshelves and publication EP-A1 0 049 443 to cargo units. Even in other respects, development has not been very rapid in this field; new solutions have come up very slowly, evidently owing to fixed ways of thinking in the field.

In the cargo unit according to the present invention, having a rectangular bottom flat provided with ends, the upper edges of the ends, preferably at least their upper corners, and respectively the lower surface of the bottom flat, having gripping and guide members for the stacking of the cargo units one on top of another and for the automatic transfer of the cargo unit, has thus according to the present invention several intermediate flats the length of which is approximately the same as the mutual distance of the ends and the width of which is at maximum that of the bottom flat, and fastening members for fastening the intermediate flats at desired heights one above another, and possibly adjacently, to bear on the ends, the ends being pivotably articulated to the flat.

The ends of a cargo unit according to the invention have preferably at least side pillars having said gripping and guide members at their upper ends and possibly at their lower ends.

The fastening members may be L-shaped fastening hooks having in one branch a pin which protrudes from it perpendicularly, is wider at its end and oblong in the transverse direction, and can engage in openings of the same shape, located one above the other and adjacently in the side surfaces facing one another in the ends and especially in the pillars, the waist part of the pin having at maximum the width of the opening in order to lock the fastening member to the end when it is turned 90°, the other branch of the fastening hook constituting a support for an intermediate flat. The intermediate flat can be fastened to this branch by using a pin which protrudes substantially perpendicularly from the upper surface of the branch, is wider at its end and oblong in the transverse direction, and is made to engage an opening of the same shape at the corresponding point in the hollow pillar of the intermediate flat, the width of the opening substantially corresponding to the thickness of the stem of the rotatable pin to lock the intermediate flats to the fastening member when the rotatable pin is turned 90°.

The ends of the cargo unit may be articulated, possibly asymmetrically, to the bottom flat of the cargo unit so that the ends can be folded against the bottom flat so that the cargo unit takes as little space as possible when it is transported empty.

The ends of the cargo units may, in addition to the side pillars, also have a middle pillar which also has at the same height a pair of openings, and the width of each intermediate flat is in this case preferably about one-half of the width of the bottom flat.

By using intermediate flats according to the present invention, not only a higher degree of filling is achieved but the cargo unit can be also made more rigid than previously, and thus it is possible to use the above-mentioned end, fastened to the bottom flat of the cargo unit possibly by means of asymmetrical hinges.

It is, of course, also possible to use the end system disclosed in Finnish patent 71908, in which the ends are detachable, in which case several bottom flats can be coupled one on top of another to form a unit the space requirement of which is the space required by one cargo unit equipped with ends, the ends being placed horizontally on the bottom flats.

Figure 2:
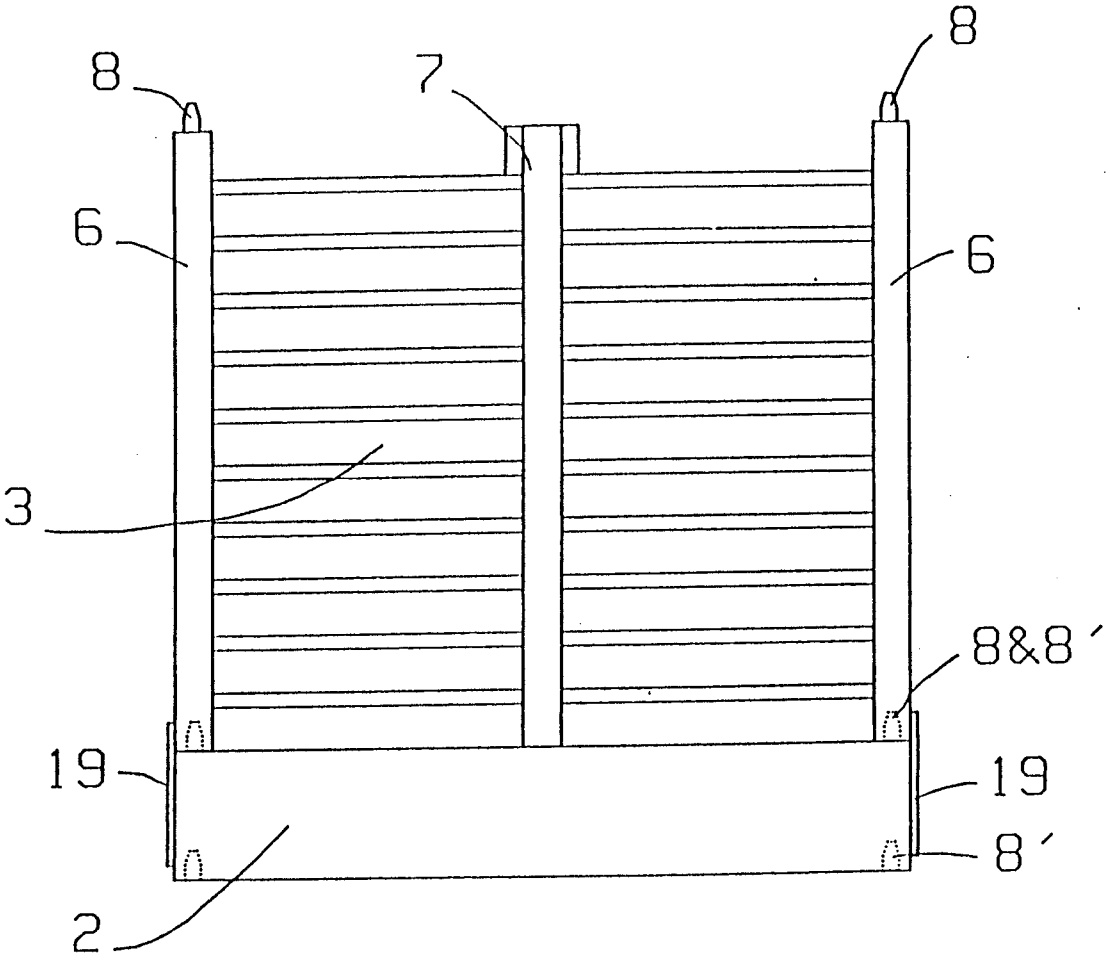
Figure 3:
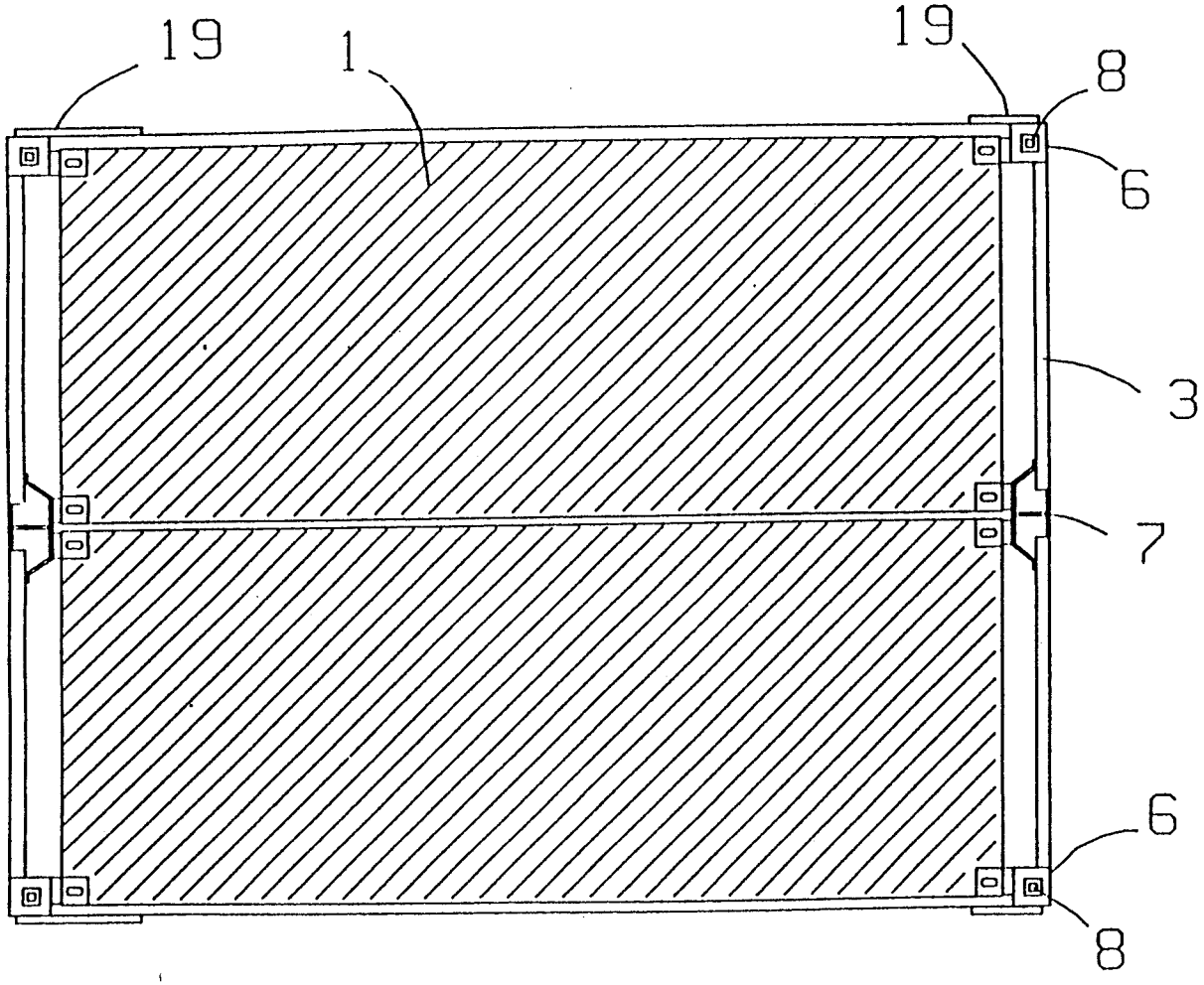
Figure 4:
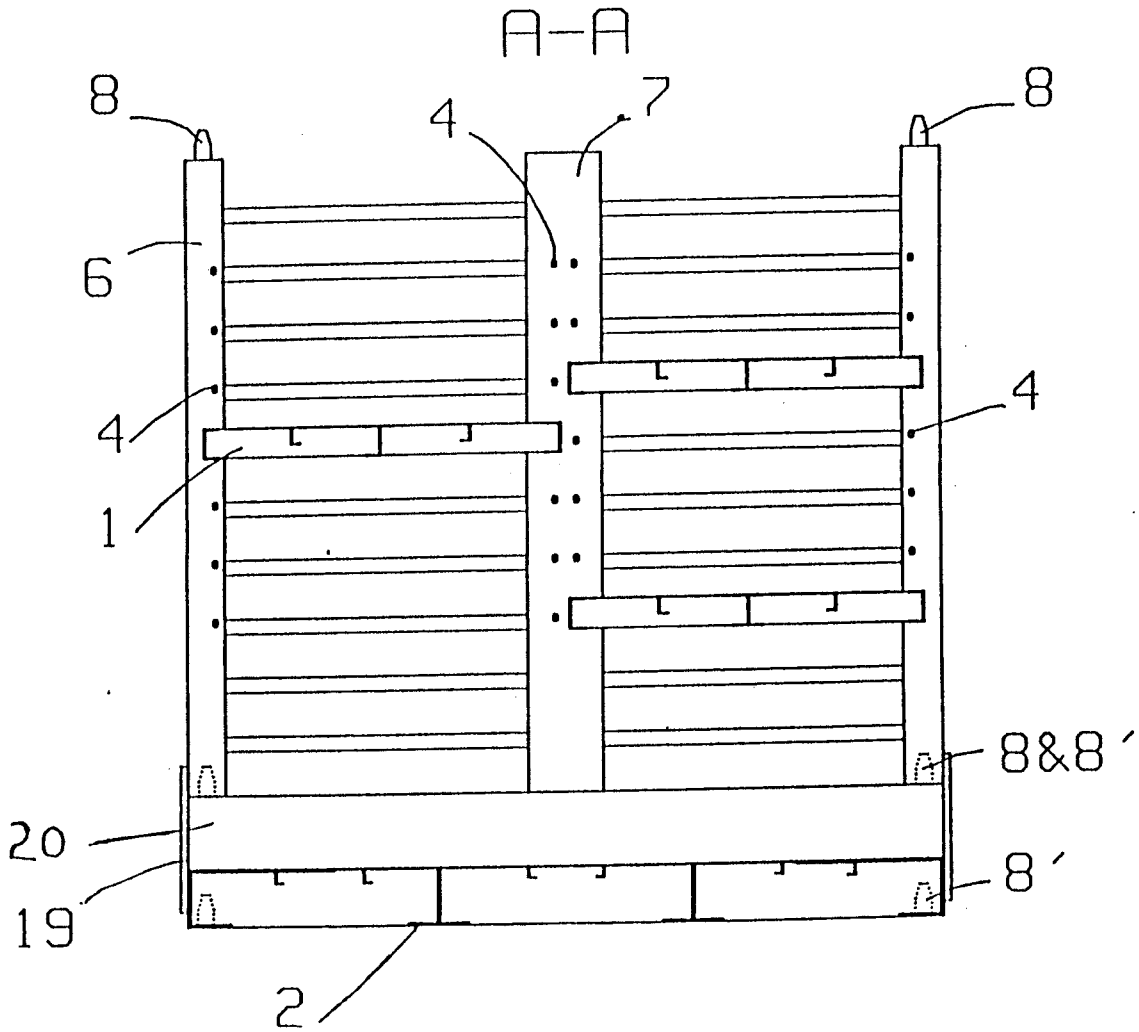
Figure 5:
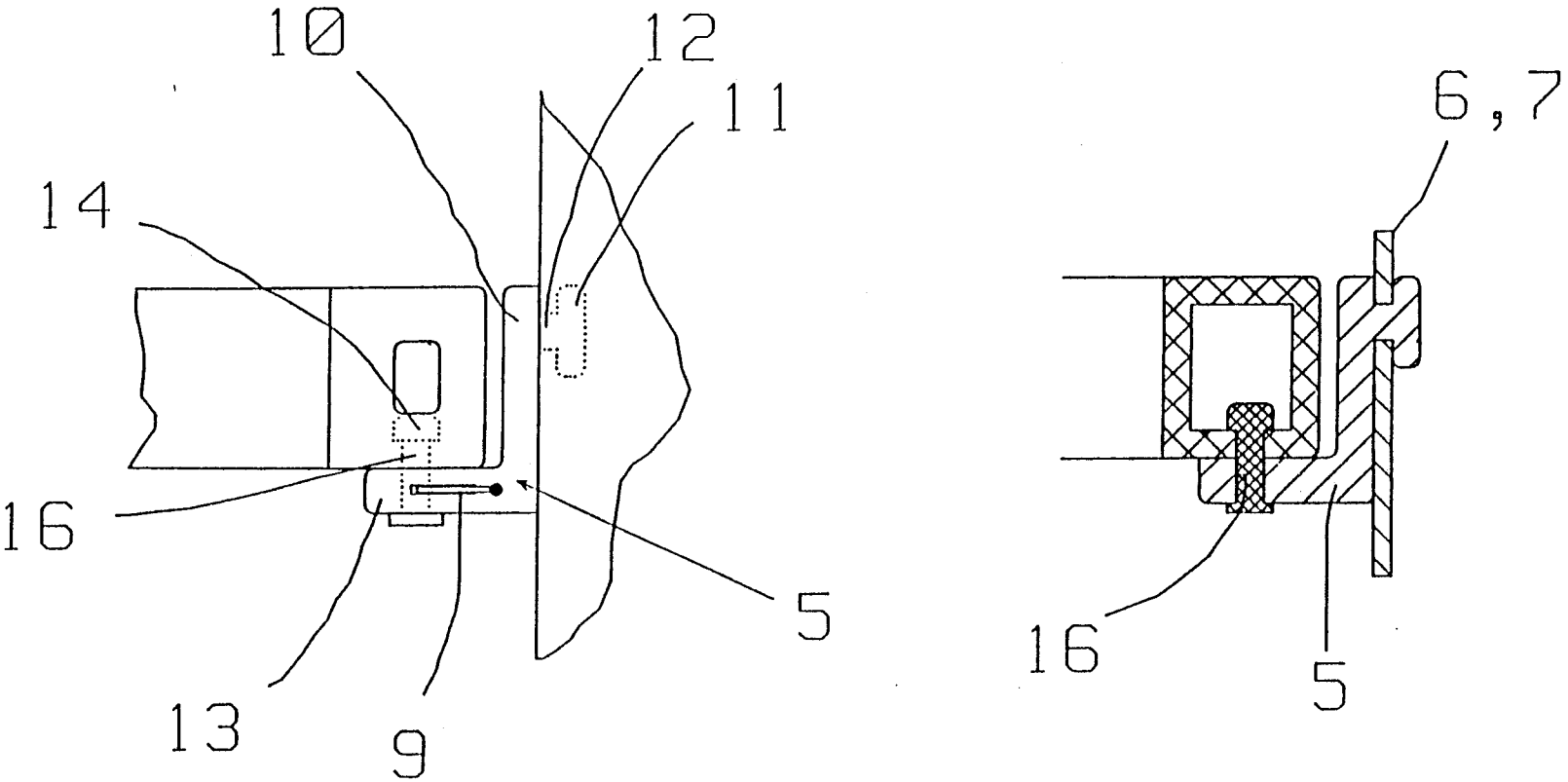
Figure 6:
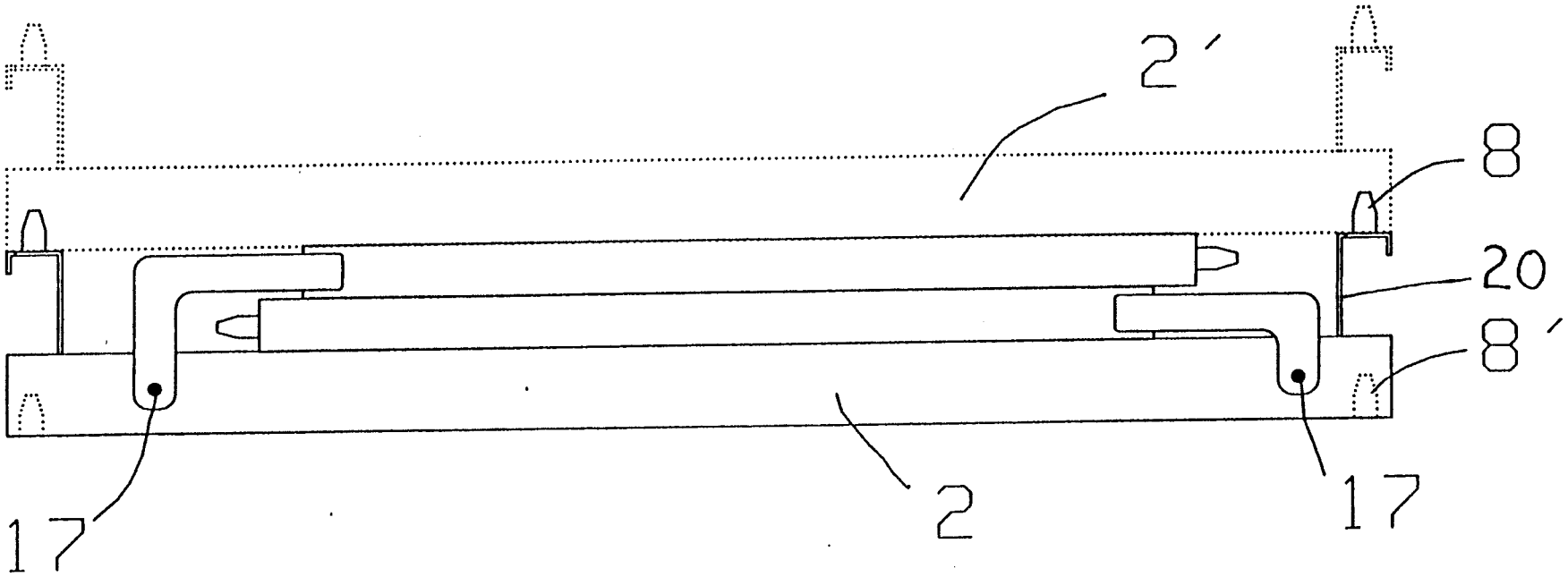

The invention is described below in greater detail with reference to the accompanying drawings, in which FIG. 1 depicts a side view of a cargo unit according to the invention, FIG. 2 depicts an end view of the same cargo unit and FIG. 3 a plan view, FIG. 4 is a section along line A—A in FIG. 1, FIG. 5 is an enlarged partial representation of FIG. 1, and FIG. 6 is a side view of the cargo unit of FIG. 1 folded up.

The cargo unit according to the invention is thus made up of a rectangular bottom flat 2 to which there are fastened, by using asymmetrical hinges 19, ends 3 which turn about pivot points 17 and the upper corners of which have fastening pins 8 provided with a transverse throughgoing bore, the pins serving as gripping and guide members when the cargo units are being stacked one on top of another and when the cargo unit is being transferred by loading trailers and overhead cranes. The corners of the lower edge of the bottom flat (2) have at corresponding points recesses 8' for the pins of the cargo unit below when cargo units are stacked one on top of another.

As can be seen in greater detail in FIGS. 2 and 4, the ends consist of two side pillars 6 and of an auxiliary pillar 7 half way between them. FIG. 4 shows that the inner surfaces of these pillars 6,7 have several openings 4 at regular intervals in the vertical direction. The auxiliary pillar 7 has two adjacent openings 4. The openings 4 are oblong in the vertical direction of the pillars.

The cargo unit also includes several intermediate flats 1, also rectangular, having a length substantially the same as the mutual distance between the ends 3 and a width approximately one-half of the width of the bottom flat 2.

The intermediate flats 1 are fastened to bear on the ends 3 at the desired heights one above another and adjacently by using fastening members 5 engaging the openings 4 in the pillars 6, 7 of the ends.

The fastening members 5 are, as is shown in greater detail in FIG. 5, L-shaped hooks having two branches 10 and 13 at right angles to each other. From the branch 10 there protrudes perpendicularly and away from the other branch 13 a pin the end 11 of which, oblong in the transverse direction, is connected to the branch 10 by a narrower waist part 12. The oblong end 11 of the pin is of such shape and size that it fits in the openings 4 in the hollow pillars 6, 7, and the waist 12 for its part is at maximum so thick that the fastening member 5 can be turned 90° when its pin is in an opening 4, to lock the fastening member 5 relative to the pillar 6, 7.

The other branch 13 of the fastening member 5 has a pin 16 which is parallel to the branch 10 and has a head 14 oblong in the transverse direction, the head being made to fit in the likewise oblong openings 18 in the lower surfaces of the corners of the intermediate flats 1 to lock the intermediate flats 1 to the fastening member 5 when the pin 16 is turned 90° about its axis. The turning can be carried out by using a lever 9 fastened to the pin 16 in the side of the branch 13 of the fastening member 5.

The fastening method described above is known per se and is described only as one example of how the intermediate flats can be fastened to the ends 3.

Since the width of the flats 1 is only one-half of the width of the bottom flat and the ends 3 are provided with an auxiliary pillar 7, which has two adjacent rows of openings, intermediate flats 1 can be fastened both one above another and adjacently, to bear on the ends 3, at the desired height according to the size of the cargo to be transferred, whereby the degree of filling of the cargo unit can be maximized without the load on top pressing the load below, in addition to which the intermediate flats 1 effectively stiffen the cargo unit.

The intermediate flats 1 used are preferably 20-foot-long flats according to the ISO standard. These flats are loaded ready at the factory or the like, and preferably with items of approximately equal height, whereafter the load is brought on the flat to the harbor and fastened to bear on the ends 3 of the cargo unit according to the invention, at a suitable height so that it will not press the load below. In the receiving entry the procedure is carried out in the reverse order, and in this manner the load can be transported on one and the same flat from the sender to the recipient; this considerably reduces the risk of damage and, furthermore, speeds up the handling of the load.

FIG. 6 shows in greater detail a cargo unit according to FIG. 1, folded up, the ends 3 folded against the bottom flat 2. In this position the cargo unit takes minimal space, and several cargo units can be stacked one on top of another, as shown with dotted lines in FIG. 6. Owing to the asymmetrical hinge arrangement of the ends 3, both ends 3 can be folded so as to be precisely parallel to the bottom flat, so that no wasted space is left between them.

As can be seen in FIGS. 4 and 6, the end edges of the bottom flat 2 have additionally low flanges 20 which also have pins 8 which have been arranged to mate with recesses 8' at the corners of the lower edge of the bottom flat 2 when cargo units are stacked one on top of another, with the ends 3 folded against the bottom flat 2.

We claim:

1. A heavy cargo unit for use in the transport of freight comprising:

a base flat having first and second ends, a top surface and a bottom surface;

first and second pillar members each having fist and second ends and being operatively associated with the base flat to be movable from a first compact position for storage and a second operative position for use in the transport of freight;

at least one intermediate flat having first and second ends and extending substantially between the first and second pillar members when said members are in said second position; and means for selectively positioning said intermediate flat at a spaced distance from the base flat.

2. The cargo unit of claim 1 which further comprises means for pivotally attaching the first end of each pillar member to the base flat so that each pillar member is movable from a first position where the pillar member is substantially parallel to the base flat to a second position where the pillar member is substantially perpendicular to the base flat.

3. The cargo unit of claim 2 wherein each said positioning means comprises an L-shaped member having one end attached to the intermediate flat and the other end attached to the pillar member.

4. The cargo unit of claim 2 further comprising first registration means for engaging the second ends of the pillar member with the bottom surface of the base flat of a vertically adjacent cargo unit when the pillar members are in said second position.

5. The cargo unit of claim 4 wherein the first registration means further includes means for the transfer of the cargo unit.

6. The cargo unit of claim 4 wherein the first registration means further includes means for engaging the second ends of the pillar members with the second ends of the pillar members of a horizontally adjacent cargo unit when the said pillar members are in said second positions.

7. The cargo unit of claim 4 wherein the first registration means comprises a pin member located on the second end of each pillar member and a pair of recesses in the bottom surface of the adjacent base flat for receiving said pin members.

8. The cargo unit of claim 2 which further comprises second registration means extending from the top surface of a bottom flat for engaging the bottom surface of the base flat of a vertically adjacent cargo unit when the pillar members are in said first position.

9. The cargo unit of claim 14 wherein the second registration means comprises a pin member mounted near each end of the top surface of the base flat and a pair of recesses in the bottom surface of the adjacent baseflat for receiving said pin members.

10. The cargo unit of claim 1 wherein each pillar member includes a plurality of apertures spaced at preselected distances between the first and second ends, and the positioning means includes a fastening member having first means for engaging the end of an intermediate flat and second means for engaging one of the apertures of a pillar member.

11. The cargo unit of claim 10 wherein said fastening member first means comprises an L-shaped member having a first branch configured to support the intermediate flat and a second branch, and said fastening member second means comprises a pin for engaging said aperture of the pillar member for attaching said L-shaped member thereto.

12. The cargo unit of claim 11, wherein each intermediate flat includes a plurality of apertures in each end portion, and wherein the first branch of the L-shaped member has a rotatable pin for engaging one said aperture in the intermediate flat for attaching the L-shaped member to the intermediate flat.

13. The cargo unit of claim 11, wherein the pin has an oblong end portion and a waist portion configured to lock the fastening member to the pillar member by rotating the fastening member ninety degrees in the plane of the pillar members.

14. The cargo unit of claim 18, wherein the intermediate flat locks to the fastening member by turning the rotatable pin ninety degrees.

15. The heavy cargo unit of claim 10 further comprising an intermediate pillar and means associated therewith for further supporting the intermediate flat, wherein each intermediate flat has a width less than the width of the bottom flat.

16. The heavy cargo unit of claim 13 further comprising at least first intermediate flat located at a first selected distance above the bottom flat and at least a second intermediate flat laterally adjacent to said first intermediate flat and located at a second selected distance above the base flat.

17. The heavy cargo unit of claim 13, wherein the first selected distance is different than the second selected distance.

18. A heavy cargo unit for use in the transport of freight comprising:

a base flat having first and second ends, a top surface and a bottom surface;

first and second pillar members each having first and second ends, the first end of each pillar member being pivotally attached to the base flat so that each pillar member is movable from a first compact position for storage where the pillar member is substantially parallel to the base flat to a second operative position for use in the transport of freight where the pillar member is substantially perpendicular to the base flat;

at least one intermediate flat having first and second ends and extending substantially between the first and second pillar member when said members are in said second position;

registration means for engaging the second ends of the pillar members with the bottom surface of the base flat of a vertically adjacent cargo unit when the pillar members are in said second position; and at least one L-shaped member having one end attached to the intermediate flat and the other end adjustably attached to the pillar member at a selected distance from the base flat.

* * * * *